US006817878B2

(12) United States Patent
Combs et al.

(10) Patent No.: US 6,817,878 B2
(45) Date of Patent: Nov. 16, 2004

(54) ZERO MOUNTING FORCE SOLDER-FREE CONNECTOR/COMPONENT AND METHOD

(75) Inventors: Christopher D. Combs, Portland, OR (US); George Arrigotti, Portland, OR (US); Ralyomand F. Aspandiar, Portland, OR (US); Tom E. Pearson, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/032,329

(22) Filed: Dec. 31, 2001

(65) Prior Publication Data

US 2003/0124885 A1 Jul. 3, 2003

(51) Int. Cl.[7] ..... H01R 13/62
(52) U.S. Cl. ..... 439/259; 439/342

(58) Field of Search ..... 439/259, 261, 439/264, 342

(56) References Cited

U.S. PATENT DOCUMENTS

| | | | | | |
|---|---|---|---|---|---|
| 3,587,037 | A | * | 6/1971 | Anhalt | 439/261 |
| 4,217,020 | A | * | 8/1980 | Holland | 439/329 |
| 4,426,123 | A | * | 1/1984 | Ritchie et al. | 439/368 |
| 5,569,045 | A | * | 10/1996 | Hsu | 439/342 |
| 5,679,020 | A | * | 10/1997 | Lai et al. | 439/342 |
| 6,413,110 | B2 | * | 7/2002 | Keller | 439/342 |
| 6,471,536 | B1 | * | 10/2002 | Chen et al. | 439/342 |

* cited by examiner

*Primary Examiner*—Gary Paumen
(74) *Attorney, Agent, or Firm*—Schwegman, Lundberg, Woessner & Kluth, P.A.

(57) ABSTRACT

A zero mounting force solder-free connector/component and method.

16 Claims, 7 Drawing Sheets

ZERO MOUNTING FORCE SOLDER-FREE CONNECTOR/COMPONENT AND METHOD

FIELD

The present invention is directed to a zero mounting force connector. More particularly, the present invention is directed to a zero mounting force solder-free connector/component and method.

BACKGROUND

Printed circuit board (PCB) assemblies are commonly comprised of a PCB, which typically has conductive traces forming circuit patterns on at least one of an upper and lower surface of a substrate, which may be resin, ceramic, plastic, glass or other suitable material. Integrated circuit (IC) chips and connectors for a variety of electronic components may be secured to the substrate and the conductive traces. The electrically conductive traces provide electrical pathways between components, which are electrically coupled to the pathways and physically secured to the resin substrate of the PCB. The connectors may include pins that pass through openings in the PCB. The pins of the connector may be electrically connected to the electrically conductive pathways by means of wave soldering, which entails moving the PCB over a flowing wave of molten solder in a solder bath to effect an electrical connection between the pins of the connector and the electrically conductive pathways. Some connectors are press-fit connectors. These press-fit connectors are often used on double-sided reflow circuit boards, which are not processed through a wave solder machine. Presently, if a large connector must be placed on a circuit board that is not undergoing wave soldering, a press-fit connector is used. The press-fit connector pins have an interference fit with plated through-holes in the PCB into which they are being pressed.

Reflow circuit boards employ small balls of solder that are located at points on the PCB where an electrical connection is desired between electrically conductive pathways and components connected thereto. When heated, the solder balls melt and re-solidify, thereby integrally electrically connecting the components to the pathways.

Servers and back plane boards frequently employ press-fit through-hole connectors to achieve a solder-free electrical connection. The through-holes are plated to provide an electrical connection from a connector or component to an electrical pathway on the same or the other side of the board. These press-fit connectors often require a special press tool configured to accommodate a specific press-fit connector's external shape. Historically, in an attempt to ensure that computers shipped to customer distribution sites may be easily configured at the site, manufacturers of computers provide PCB's that are custom designed to accommodate a host of varying consumer needs. Those needs include connector options that allow such components as memory modules and peripheral interconnect (PCI) connectors. Currently the mother boards, that is the main circuit board of the computer that contains the primary components of the computer system, such as the processor, main memory, support circuitry and a bus controller, are also "stuffed" with extra connectors to accommodate dual inline memory modules (DIMM's) and PCI connectors that are not needed on every original equipment manufacturer (OEM) product line or at every OEM. These added components that have been stuffed onto the PCB add cost to the product without attendant value when the end user of the products do not require extra PCI or DIMM connectors. This current practice is expensive and results in system boards that are more expensive than they need to be for the products in which they are used.

From the foregoing it is apparent that significant cost savings would be available if the reseller at the point of sale could add PCI connectors or memory modules rather than increasing the computer's basic cost when the PCIs or memory modules are included on the PCB when they are not needed.

BRIEF DESCRIPTION OF THE DRAWINGS

The foregoing and a better understanding of the present invention will become apparent from the following detailed description of example embodiments and the claims, when read in connection with the accompanying drawings, all forming a part of the disclosure of this invention. While the foregoing and following written and illustrated disclosure focuses on disclosing example embodiments of the invention, it should be clearly understood that the same is by way of illustration and example only and that the invention is not limited thereto. The spirit and scope of the present invention are limited only by the terms of the appended claims.

The following represents brief descriptions of the drawings, wherein.

DETAILED DESCRIPTION

Figure 1:
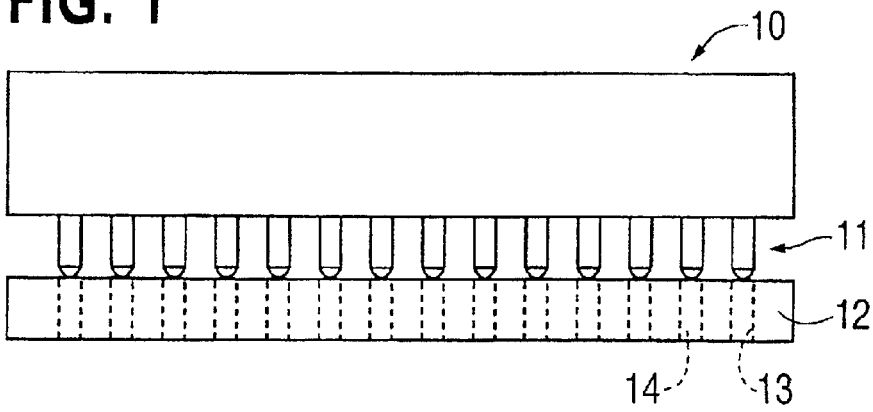
FIG. 1 is a side view of a press-fit connector and PCB.

Before beginning a detailed description of the subject invention, mention of the following is in order. When appropriate, like reference numerals and characters may be used to designate identical, corresponding or similar components in differing figure drawings. It is important to note that the present invention is not limited to the examples and the example embodiments shown and described. In this regard, terms such as connector, component or socket are intended to suggest types of devices wherein the present invention finds utility. Accordingly, the term socket or connector is intended to describe a device designed to provide electrical connections and mechanical support for an electronic or electrical component requiring convenient placement. It is to be further understood that the present invention is applicable for use with all types of connectors, and all electronic packages and integrated circuit (IC) devices, including new microprocessor chips, which may become available as computer technology develops in the future. Further, the present invention is not limited to use in computer systems, but is suitable for applications in many industries and/or environments such as automotive, telecommunications, etc. However, for the sake of simplicity, discussions will concentrate mainly on exemplary use of a zero mounting force solder-free connector for use in conjunction with system boards, mother boards, daughter boards, dual in-line memory modules (DIMMS), peripheral component interconnect (PCI) connectors, although the present invention is not limited thereto.

This invention is not only directed to a zero mounting force solder-free connector, but also embraces a new class of PCBs that provide a universal capacity to accommodate virtually any electrical component that utilizes the universal zero mounting force connector of the instant invention. In this regard the invention involves an elegantly simple cooperation of a uniquely configured construction of a PCB and connector that provides for the establishment of a universal, multifunction PCB that will accommodate a vast array of connectors and related electrical components, thereby providing a highly advantageous, low cost, high profit margin approach to manufacturers and assemblers of every conceivable type of electrical equipment that employs generally a circuit board and more particularly a PCB.

Both a connector/component and a socket are descriptive terms of a device that may be employed to interconnect an electrical component to a circuit board. The term zero insertion force (ZIF) is frequently used to describe an electrical connection between an electronic component coupled via a connector to a circuit board by conventional means, such as a pin that passes through a plated through-opening in the circuit board, which is then wave soldered in place. Alternatively solder balls may be placed between connector pins and electrically conductive pads on the PCB. A reflow process, which entails melting and re-solidifying the solder balls, is employed to integrally, electrically and structurally interconnect the pins to the pads to produce a unified structure.

Connectors may also be secured to the PCB by mechanical arrangements, which involve mechanical elements of the connector physically cooperating with openings through the PCB to mechanically secure the connector to the board. These less advantageous mechanical arrangements may include plated, cone shaped through-openings in the PCB which accommodate cone shaped connector pins that matingly engage the cone shaped openings. A connector in this type of arrangement is mechanically secured to the PCB. The mechanical connection of the connector to the PCB provides a force essential to force fit the cone shaped pin connectors of the connector pins to the cone shaped plated through-openings of the PCB.

Reference is now made to FIG. 1 which illustrates a state-of-the-art, press-fit connector 10 and PCB 12 that includes a plurality of connector pins 11 designed to have an interference fit with the plated through-holes in the PCB 12, two of which (13, 14) are referenced. A mechanical press, not shown, may be required to achieve the large amount of force required to insert the press-fit connector 10 to the PCB 12. Such arrangement is disadvantageous in that application of the large amount of force has a potential to cause damage to any of the connector 10, pins 11 and/or PCB 12.

Figure 2:
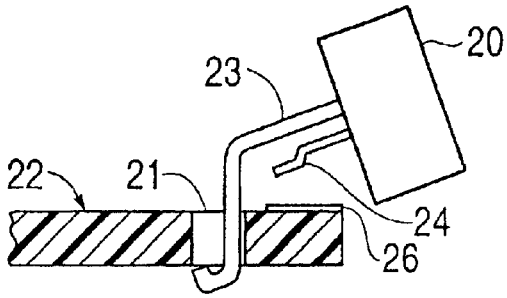
FIG. 2 illustrates a preliminary placement of a surface mount component on a PCB.
Figure 3:
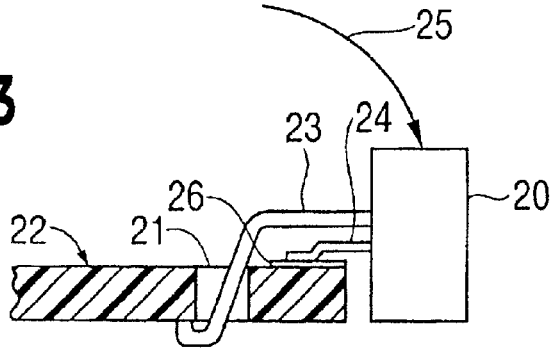
FIG. 3 illustrates a method of attaching a surface mount component to a PCB.
Figure 4:
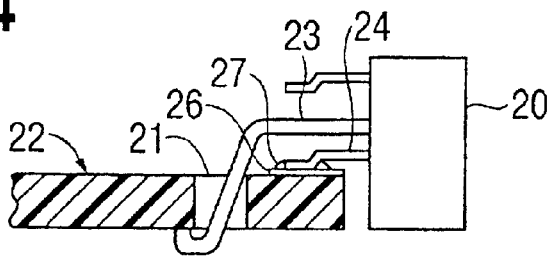
FIG. 4 illustrates a final assembly step of soldering a surface mount component in place on a PCB.

Attention is now directed to FIGS. 2, 3 and 4 which, when taken together along with an explanation that follows, will provide an understanding of a less advantageous arrangement involving a zero mounting force component 20 positioned above an aperture 21 in PCB 22. The component 20 includes a latch element 23 configured as shown. The latch element 23 is shown inserted in the aperture 21. The component 20 further includes a solder tail 24. The PCB 22 is provided with a solder pad 26. FIG. 3 illustrates a further step in securing the component 20 to the PCB by means of the rotation of the component 20 from the position depicted in FIG. 2 to the location shown in FIG. 3. The rotational movement is conveyed in FIG. 3 by means of arrow 25. The presence of gravitational pull on the component 20 is all that is required to accomplish a zero mounting force of the component 20 on the PCB 22. In FIG. 3 it will be observed that the solder tail 24 is shown resting upon the solder pad 26. FIG. 4 differs from FIG. 3 in that solder 27 is shown reflowed around the solder tail 24 and the solder pad 26.

The zero-mounting force component and PCB arrangement shown in FIGS. 2 to 4 inherently have the following deficiencies: (a) components must be mounted on the PCB at the PCB's periphery or edges; (b) the component must be soldered to a circuit board solder pad in order to provide structural integrity between the PCB 22 and the component 20.

Figure 5A:
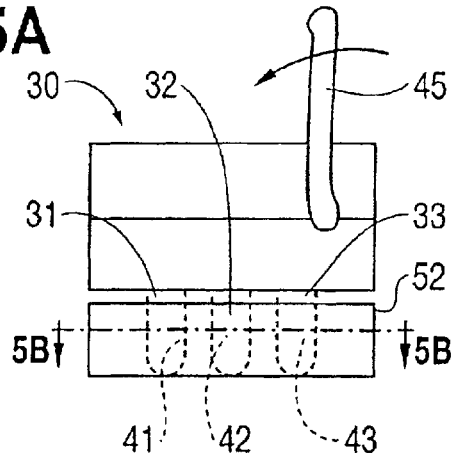
FIG. 5A is a side view of a surface mount component/connector embodying the invention inserted in a PCB to which it is to be secured.
Figure 5B:
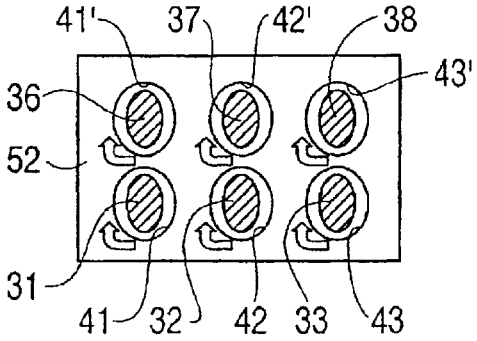
FIG. 5B is a section view taken along line 5B—5B in FIG. 5A.

Reference is now made to FIGS. 5A, 5B, 6A, 6B and 7 which, when taken together with the description that follows, will provide a broad overview of an example zero force surface mount component/connector embodying the invention. The term component/connector throughout the description that follows will be employed interchangeably to describe a connector or component. In FIG. 5A, a zero force surface mount component 30 having connector pins 31, 32, 33 is shown inserted through plated through-openings 41, 42, 43 in PCB 52. In FIG. 5A, surface mount actuation lever 45, to be described more fully hereinafter, is shown in an upright pre-actuation position. In this pre-actuation position, the pins 31, 32, 33 and 36, 37, 38 (FIG. 5B) are positioned in a mating manner in plated through-openings 41, 42, 43 and 41', 42', 43'. These pins 31, 32, 33 and 36, 37, 38 are oval in cross-section. The plated through-holes 41, 42, 43 and 41', 42', 43' also have an oval cross-section, as is readily discernable in FIG. 5B. When the pins are in the position shown in FIG. 5B they exist in a mating relationship with the openings, in that the pins and openings are of such a nature that the pins 31, 32, 33 and 36, 37, 38 freely fit, without friction (zero insertion force), within the plated through-openings 41, 42, 43 and 41', 42', 43'. The term oval is intended to convey the idea that oval shape is like that of a section of an egg. More specifically, the term oval is intended to embrace a substantially elliptical geometric cross-section. Whenever the term oval or elliptical is employed to describe an opening with a pin in a mating relationship, it is intended to convey the idea that a pin fits freely within the opening. When the oval pin is freely fitted into an oval opening, the relationship is described as a first position or an initial position.

Figure 12:
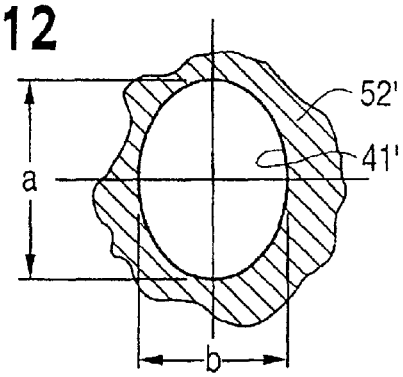
FIG. 12 is a partial section of a portion of a PCB having an oval shaped opening.

The nature of the oval openings may best be appreciated by a study of FIG. 12 where an oval opening 41' has a long internal dimension, which is labeled as a, and a short dimension labeled b. Note also that each oval shaped pin, such as pin 31' in FIG. 13, has a long dimension a', and a short dimension b'. It may be advantageous for each of the oval pins to be provided with a maximum external dimension a' that slightly exceeds the oval opening short dimension b. Accordingly, when an oval pin is rotated 90° to be in a second position, to thereby be in a structural interference fit with the long dimension a' of the oval pin, the pin binds against the oval opening wall at the oval opening short dimension b. The movement of the oval pin from the first position to the second position creates a solder-free mechanical and electrical connection between the oval pins and the sides of the plated through-holes.

Figure 7:
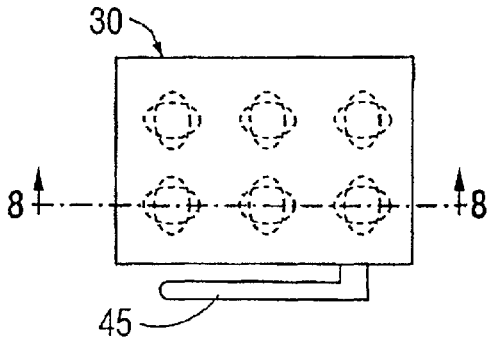
FIG. 7 is a top view of FIG. 6A.
Figure 8:
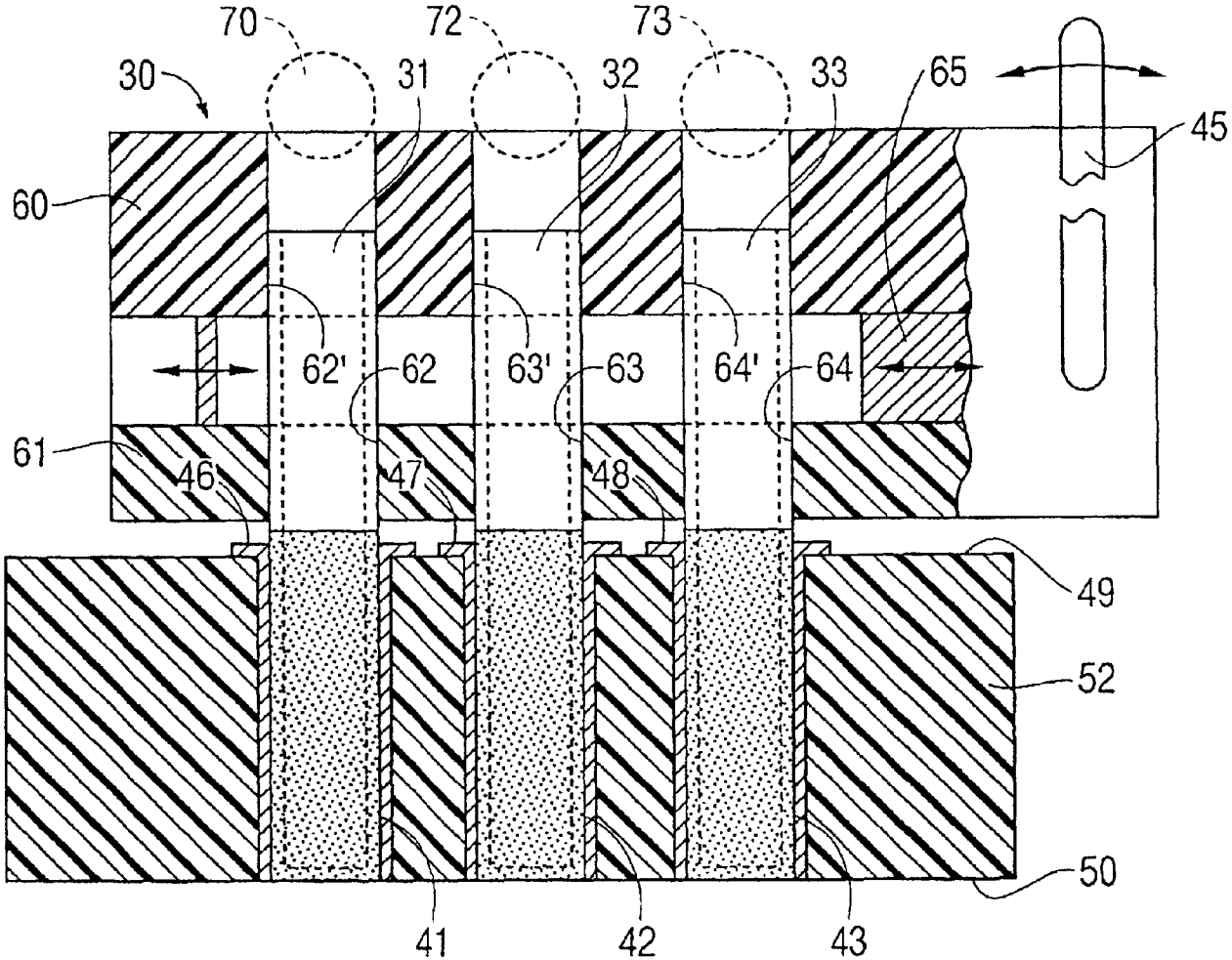
FIG. 8 is a cross-section taken along line 8—8 in FIG. 7.

Attention is now directed to FIG. 8, which is a cross-section taken along lines 8—8 in FIG. 7. In order that the following explanation of this figure most clearly describe the structural detail of various aspects of the component/connector 30 and PCB 52, some details have been depicted with exaggerated size. This will enable a quick comprehension of the nature of the instant invention. In this regard the PCB 52 and the plated through-holes 41, 42, 43 are shown greatly enlarged in thickness. In the actual practice of the invention the plated through holes possess a thickness that is just sufficient to coat the oval through-hole-opening with an electrically conductive material. In a like manner, each of the plated through-pin-openings 41, 42, 43 are shown integrally joined to circuit pads 46, 47, 48, which, in turn, are part of conductive circuit pathway traces (not shown) on an upper surface 49 of PCB 52. Although not illustrated, it is to be understood that circuit pads and circuit pathway traces may also be present on a bottom surface 50 and/or intra-PCB lamination layers (not shown) of the PCB 52.

Figure 11:
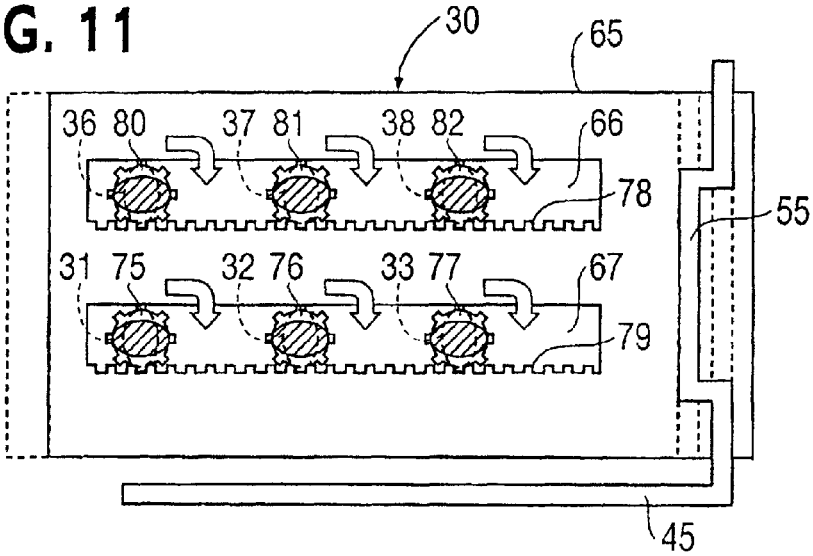
FIG. 11 is a top view of a lever, cam and plate mechanism embodying one form of the invention.

The connector/component 30 is comprised of a pair of spaced apart planar housing elements 60, 61 that have disposed between them a sliding cam actuated plate 65. The physical construction of one example embodiment of a cam activated slide plate 65' is shown in FIG. 11, to be described more fully hereinafter.

The oval cross-section pin connectors 31, 32, 33 are shown extending through housing element 61 and terminating, as shown, in housing element 60. In the present example of the invention, the housing elements 60, 61 are provided with oval cross-section bores 62, 63, 64 and 62', 63', 64'. At the upper ends of the bores 62', 63', 64', there may be solder balls 70, 71, 72, shown in dotted outline, the role and function of which will be explained hereinafter. The cam actuation lever 45, here shown in an unactuated position, is coupled via cam (not shown) to sliding plate 65 to cause the plate 65 to reciprocate, when the lever 45 is moved back and forth through an arcuate travel of, for example, 90°.

Figure 9:
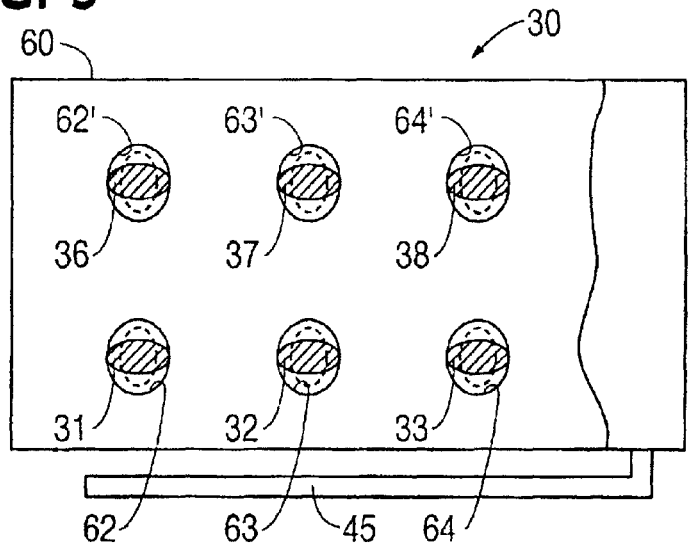
FIG. 9 is a cross-section taken along line 9—9 in FIG. 6A.

In FIG. 9, the actuation lever 45 is shown in its fully actuated position, which has caused the oval cross-section pins 31, 32, 33, and 36, 37, 38 to rotate toward 90° and mechanically bind with the oval cross-section bores 62, 63, 64 and 62', 63', 64'.

In addition to rotating within and binding with the connector bores 62, 63, 64, 62', 63', 64', portions of the pins 31, 32, 33, 36, 37, 38 which protrude externally to the housing element 61 are inserted into and subsequently also rotate within and bind with oval cross-sectional through-pin-openings 41, 42, 43, etc., respectively. By the pins wedgingly mating with the through-pin-openings, the connector (and anything attached thereto, i.e., semiconductor package) is mechanically secured to the PCB 52 without the necessity of a solder reflow process. Also, by reversing the lever action, the connector can be just as easily disengaged and removed from the PCB 52 (e.g., for servicing and replacement).

While the above example descriptions describe the pins 31, 32, 33, 36, 37, 38 as wedgingly mating with both the connector's bores 62, 63, 64, 62', 63', 64' and the PCB's through-pin-openings 41, 42, 43, etc., practice of the present invention is not limited thereto. For example, practice may be had with an arrangement where the pins 31, 32, 33, 36, 37, 38 do not wedge with the connector's bores 62, 63, 64, 62', 63', 64'. For example, a portion of the pins which extend into the housing element 60 may simply be round (rather than oval) and tightly fit within a round (rather than oval) connector bore so as to facilitate both rotation of the pin, as well as electrical connection between the pin and connector bore.

Figures 10A, 10B, 10C:
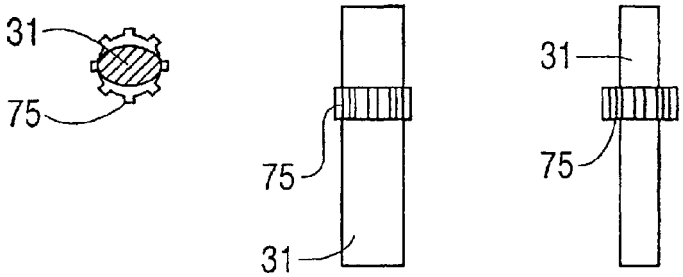
FIG. 10A is a front view of a connector pin that embodies the invention.
FIG. 10B is a top view of FIG. 10A.
FIG. 10C is a side view of FIG. 10A.

Attention is now directed to FIGS. 10A, 10B and 10C. FIG. 10A depicts the front view of a single, oval cross-section connector pin, such as pin 31. In this embodiment of the invention the pin 31 is provided with a pinion gear configured portion 75.

Figure 6A:
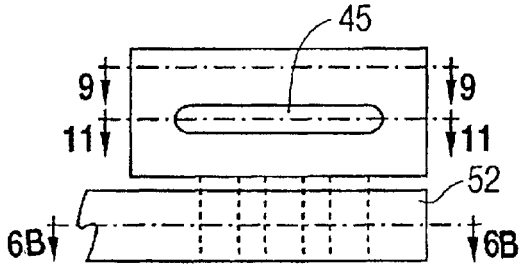
FIG. 6A is a side view of the surface mount component/connector of FIG. 5A wherein the component/connector is shown secured on the PCB.
Figure 6B:
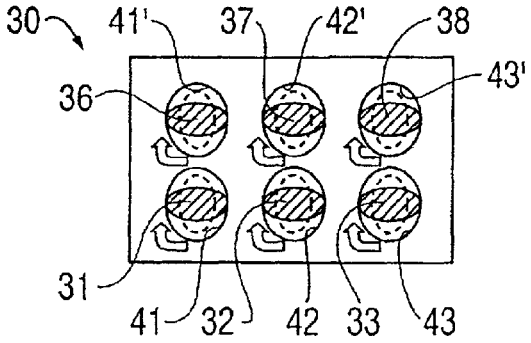
FIG. 6B is a section view taken along line 6B—6B in FIG. 6A.

Attention is now directed to FIG. 11, which depicts a cross-section of the connector/component 30, taken along line 11—11 in FIG. 6A. As just noted, the oval cross-section connector pins 31, 32, 33 and 36, 37, 38 are each provided with pinion gear portions 75, 76, 77 and 80,81, 82. The sliding plate 65 is comprised of non-conductive material, such as plastic, and includes a pair of rectangular openings 66, 67, which are provided with rack gear teeth sets 78, 79. The actuation lever 45 includes a jog portion 55 which cooperates with the sliding plate 65. When rotated, the jog portion 55 bears against the plate 65 to move the same. The details of the cam arrangement are not essential to the practice of the invention. In this regard, a rotating screw and gear arrangement, with the screw secured to the plate, would also provide a mechanism sufficient to cause the plate to reciprocate when a worn gear engages the screw. The invention also embraces the use of a rotating cam lobe that would engage the plate 65 and cause it to reciprocate.

One of the elegant attributes of the instant invention resides in a self centering function that arises when a connector pin is adapted to cooperate with an opening in a PCB, in the manner just described, such that when the pin is in a first position, the pin freely enters the opening, and when the pin is moved to a second position, the pin binds in the opening to thereby establish a mechanical connection with the opening and an electrical connection to a conductive pathway on the board. More particularly, when the pin is first positioned in a plated through-opening in a PCB and then moved to a second position, the oval pin cooperates with the opening so as to cause the pin to self-center the pin within the opening.

Figure 13:
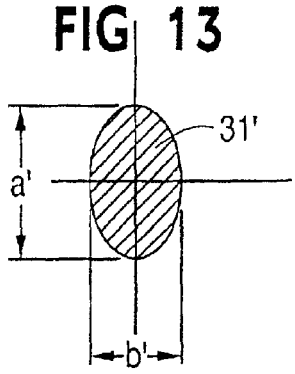
FIG. 13 is a cross-section of a connector pin embodying the invention.
Figure 14:
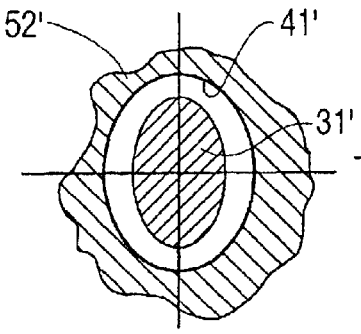
FIG. 14 illustrates an oval pin in an oval opening of a PCB that embodies the invention.
Figure 15:
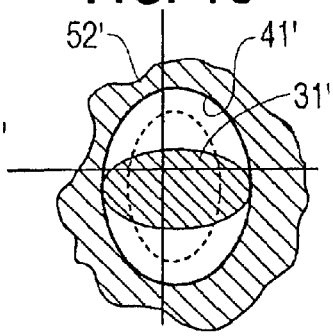
FIG. 15 shows an oval pin secured in an oval opening of a PCB.
Figure 16:
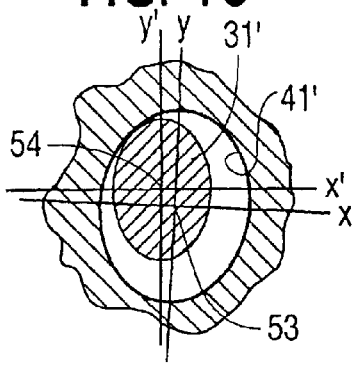
FIG. 16 depicts an oval pin positioned in an off centered relationship to an oval opening in a PCB.

The nature of this self-centering feature will be described when FIGS. 12, 13, 14, 15 and 16 are next studied in conjunction with the explanation that follows, as indicated hereinbefore. FIG. 12 is a partial section of a PCB 52', which is provided with an oval-shaped, plated through-opening 41'. FIG. 13 is a cross-section of an oval-shaped connector pin 31'. FIG. 14 shows the pin 31' in a first position freely disposed within the PCB opening 41', whereas FIG. 15 illustrates the oval-shaped connector pin 31' moved to a second position, where the pin 31' binds in the opening 41', thereby establishing a mechanical connection with the opening and an electrical connection with the plated through surface of the openings 41. Simply viewing FIG. 15 with the pin 31 perfectly centered in the opening 41 does not convey the elegant manner in which the pin 31, because of its oval cross-section and its cooperation with oval opening 41, automatically centers the pin 31' in the opening 41'. The significance of this highly advantageous self-centering nature of the instant invention will be recognized when FIG. 16 is now studied, in conjunction with an explanation that follows. Accordingly, FIG. 16 shows an oval-shaped connector pin 31' inserted in the opening 41', in an off-centered relationship to the labeled centered point 53 of X and Y axes of the oval opening 41'. The off centered pin 31 has axes X' and Y' that intersect at the center point 54. When the pin 31' with its X' and Y' axes is rotated 90° relative to the X and Y axes of the opening 41', the pin 31' becomes perfectly centered in the opening 41', as shown in FIG. 15. This flawless centering enhances the precise positioning of multiple component/connectors in close proximity to each other on densely stuffed PCBs.

The just-noted advantage will become apparent when a less advantageous approach, present in a rotating contact ZIF connector, is next described, in conjunction with the illustrations of FIGS. 17, 18, 19 and 20.

Figure 17:
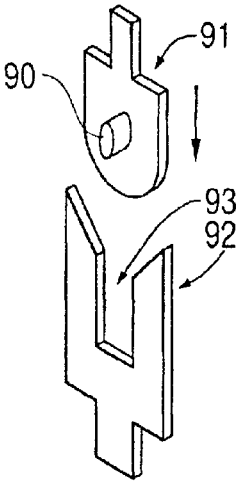
FIG. 17 shows a view of a less advantageous rotating wedge connector arrangement prior to assembly.
Figure 18:
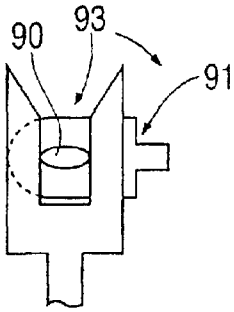
FIG. 18 shows the less advantageous rotating wedge connector of FIG. 12 fully assembled.
Figure 19:
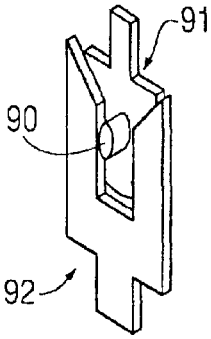
FIG. 19 shows a less advantageous rotating wedge connector in an off centered position.
Figure 20:
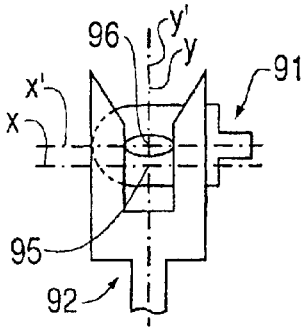
FIG. 20 shows the less advantageous wedge connector of FIG. 19 fully assembled in an off centered manner.

FIG. 17 shows in perspective form a rotating wedge 90 mounted on a paddle-shaped electrical contact 91. A fork-shaped electrical contact 92 is provided with a slot 93 into which electrical contact 91 and associated wedge 90 may be inserted. Once the electrical contact 91 and the wedge 90 are positioned in the slot 93 and the electrical contact 91 is rotated through 90°, the wedge 90 binds in the slot 93 as shown in FIG. 18. In order for the wedge 90 of the electrical contact 91 to become perfectly centered in the slot 93, the wedge must be perfectly centered in the slot 93. Take note in FIG. 19, that when the electrical contact 93 with its wedge 90 is not perfectly inserted in the center of the slot 93 and the electrical contact 91 and associated wedge is rotated 90 degrees and the intersection point 96 (see FIG. 20) of the X' and Y' axes of the electrical connector and wedge 90, 91 is not coincident with the intersection point 95 of the X and Y at the center of the slot 93, the resultant electrical connection will be off-center. While this arrangement may well serve as a means of electrically connecting a pair of contacts, the arrangement falls dismally short of insuring a highly advantageous, centered relationship between electrical contacts as is provided for by the instant invention.

Figure 21A:
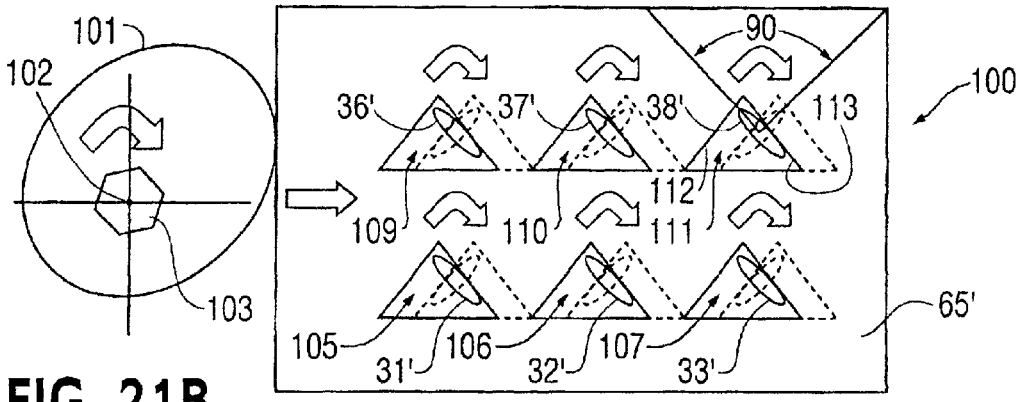
FIG. 21A is a schematic showing of an internal cam mechanism embodiment of the invention that drives a plate which rotates pins using a wedge slider method.
Figure 21B:
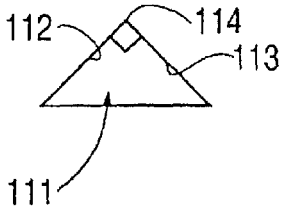
FIG. 21B is a schematic showing of a triangular shaped opening of the type present in the sliding plate of FIG. 21A.

Reference is now made to FIG. 21A, which is a schematic showing of a cam and sliding plate arrangement 100 that may be usefully employed in the practice of the instant invention. A cam lobe 101 is shown mounted for rotation about an eccentrically positioned center point 102. A hexagonal opening 103 in the cam lobe 101 is intended to accommodate a hexagonally shaped tool (not shown), which, when inserted in the opening 103 and then rotated, causes the cam lobe 101 to bear against the sliding cam follower plate 65', to reciprocate the same. The plate 65' may be fashioned of electrically non-conductive material. Flattened, elliptically-shaped pins 31', 32', 33' and 36', 37', 38' are shown disposed in triangular-shaped openings 105, 106, 107, and 109, 110, 111. These triangular-shaped openings 105, 106, 107, and 109, 110, 111 are each provided with two sides that intersect at an apex to form a 90° angle between the sides. FIG. 21B depicts, in a schematic fashion, an example shaped opening 111, with sides 112, 113 intersecting at right angles to create a vertex 114. Returning to FIG. 21A, it will be noted that movement of the sliding cam follower plate 65' will cause the triangular-shaped openings 105, 107, 107 and 109, 110, 111 to be shifted to the right, where they are shown unreferenced in a broken line. An explanation of how the flattened elliptical pins 31', 32', 33' and 36', 37', 38' are rotated toward 90° will be provided by focusing on a single triangular-shaped opening 111. It will be noted that movement to the right of sliding cam follower plate 65' causes side 112 to engage flattened elliptical pin 38' and force the pin 38' to rotate through 90°.

Figure 22:
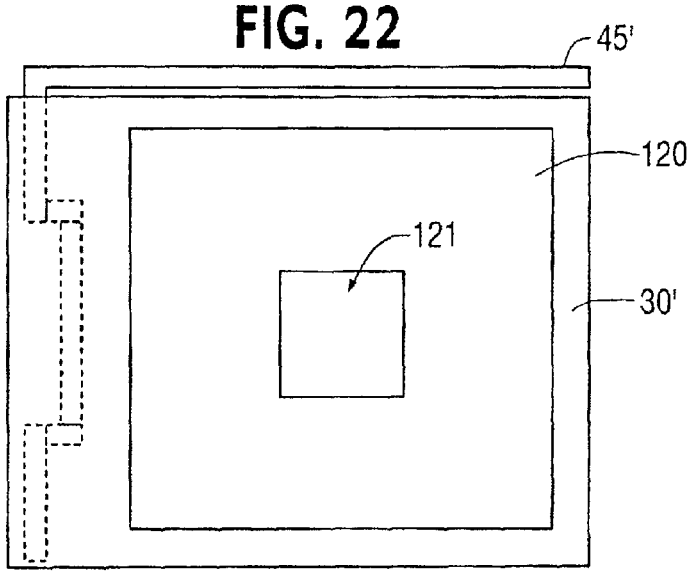
FIG. 22 is a top view of a lever actuated packaged processor positioned on a zero mounting force connector utilizing the invention.
Figure 23:
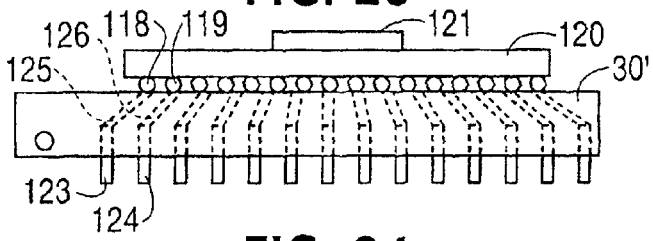
FIG. 23 is a side view of the packaged processor and zero mounting force solder-free connector of FIG. 22.
Figure 24:
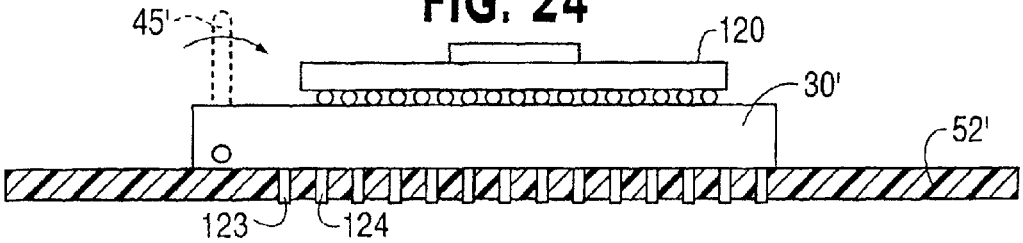
FIG. 24 is a side view of a packaged processor and zero mounting force connector of FIG. 23 secured in place on a PCB.

Attention is now directed to FIGS. 22, 23 and 24, which illustrate a further example embodiment of the invention, where an electronic component processor package 120, with its die 121, is shown mounted in a zero mounting force solder-free connector 30' that includes an actuation lever 45' of the nature described hereinbefore. Typical component processor packages would include a flip chip ball array (FCBA); an organic land grid array (OLGA) or a plastic ball grid array (PBGA) to name a few of the many components that may be used with the zero mounting force solder-free connector 30' that embodies the instant invention.

FIG. 23 is a side view of the component package 120 with its die 121 and zero mounting force solder-free connector 30' of the nature described with reference to FIG. 22. Disposed between the electronic package 120 and the connector 30' are shown a plurality of solder balls, two of which (118, 119) are referenced. These solder balls are in surface contact with electrical tail portions that protrude through the electronic component package 120, but are not shown in this drawing. A plurality of connector pins such as 123, 124, having oval cross-sections, are positioned in the connector 30' and operate in the manner earlier described in the specification. Passageways such as 125, 126, shown in dotted out line, allow melted solder, during a reflow process, to flow toward and electrically and mechanically interconnect the connector 30' with its connector pins 123, 124, to electronic package 120. FIG. 24 is also a side view of the electronic package 120 and zero mounting force connector 30' with connector pin inserted in mating plated through-openings in the PCB 52'. Although not shown in this just described series of FIGS. 22, 23, 24, it should be readily appreciated that in FIG. 24 movement of the actuation lever 45 (shown in dotted outline) toward 90° will cause the connector pins such as 123, 124 to bind in the plated through-openings in the PCB 52', whereupon a reflow process may follow, which may cause the solder to melt and then re-solidify to produce a unitary component/connector and PCB that embodies the invention.

Example embodiments of the present invention may, therefore, be advantageous, in that a receiving substrate (e.g., motherboard, interpower board) may only need the specially-shaped (e.g., oval) plated through-holes to receive and wedgingly mate with the pins of the connector. Further, sockets can be added to the receiving substrate at any time in a ZIF and solderless manner, such that originally-provided receiving substrates do not originally need such connectors, and thus, may be able to be more cheaply provided.

Thus, the instant invention avoids initial increased connector costs by providing PCB's with unique, plated through-holes that cooperate with component/connector self-centering pins in a solder-free manner. The connector and related components could be provided at the OEM or by an end user. It follows logically that if the reseller adds only essential components required by the customer, there will follow an attendant reduction in cost and commensurate increase in profit margin over existing built-in costs.

Finally, the zero mounting force connector of the instant invention obviates the need, inconvenience and attendant expense for individualizing tools to press-fit connectors/components into a PCB.

Figure 25:
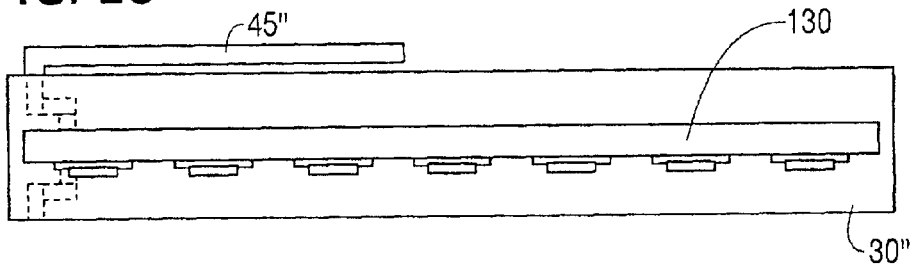
FIG. 25 is a top view of a memory module mounted in a zero mounting force solder-free connector that embodies the invention.
Figure 26:
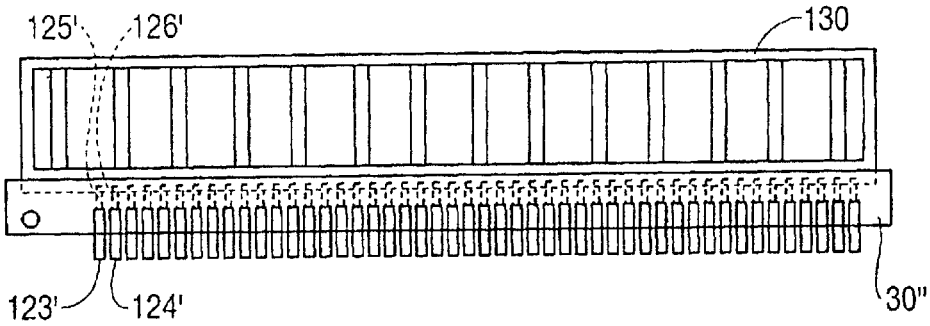
FIG. 26 is a side view of FIG. 25.
Figure 27:
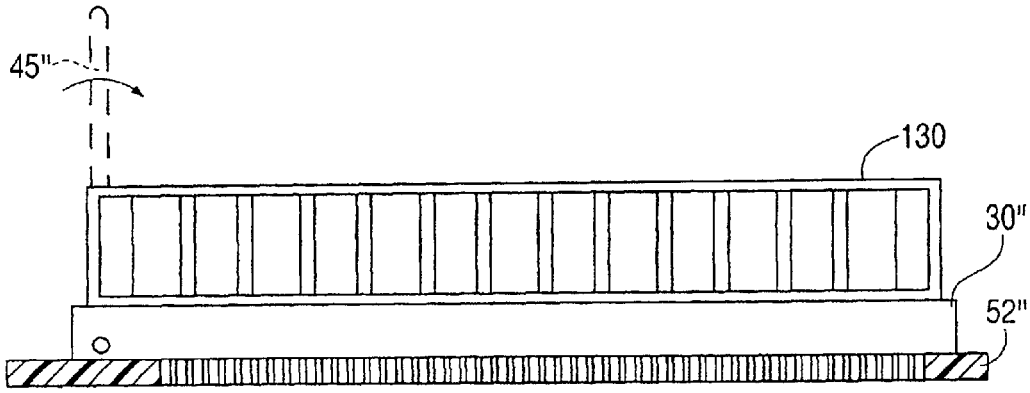
FIG. 27 is a side view of a memory module connector that incorporates the invention to secure the memory module connector to a PCB.

FIGS. 25, 26 and 27 illustrate another embodiment of the invention in which a memory module 130 is shown mounted on a zero mounting force solder-free connector 30". The details of the memory module 130 form no part of the invention and a detailed description of this module is not required to appreciate this embodiment of the invention. FIGS. 25, 26, 27 are similar in nature to the component/connector arrangement shown and described above with respect to FIGS. 22, 23, 24. Accordingly FIG. 25 shows an actuation lever 45" in a fully actuated position cooperating with a zero mounting force solder-free connector 30". FIG. 26 is similar in nature to FIG. 23 and depicts connector pins, such as 123', 124' and solder passage ways 125', 126'. Solder balls not shown may also be present. Finally, FIG. 27 illustrates the memory module 130 and the zero mounting force solder-free connector that embodies the invention in position as shown on PCB 52". The actuation lever 45' is shown in dotted outline in an unactuated position. Rotation of the lever 45" in the direction indicated by the unreferenced arrow secures the connector pins mechanically and electrically to the PCB 52. A subsequent reflow process may, in the manner described hereinbefore, mechanically and electrically interconnect the memory module 130 to the connector 30".

In the broadest sense, the present invention involves a method comprising the forming of an opening in a PCB followed by inserting a connector pin adapted to freely enter the PCB opening when the pin is in a first position and then moving the pin from the first position to a second position to thereby cause the pin to bind in the opening and establish a mechanical connection with the opening and an electrical connection to a conductive pathway on the PCB.

The method more particularly entails providing the pin with a substantially elliptical cross-section that mates with an elliptical cross-section of the opening in the PCB, which is a first position. When the pin is moved to a second (e.g., rotated) position, the pin binds with the PCB opening. The method may further embrace plating through the opening in the PCB to further enhance an electrical connection between the pin and the conductive pathway on the PCB.

In concluding, reference in the specification to an example embodiment, etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. Furthermore, for ease of understanding, certain method procedures may have been delineated as separate procedures, however, these separately delineated procedures should not be construed as necessarily order dependent in their performance, i.e., some procedures may be able to be performed in an alternative ordering, simultaneously, etc.

This concludes the description of the example embodiments. Although the present invention has been described with reference to a number of illustrative embodiments thereof, it should be understood that numerous other modifications and embodiments can be devised by those skilled in the art that will fall within the spirit and scope of the principles of the invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

For example, the electrical contacts of the pin insertion apertures of component packages may be available in a variety of sizes and shapes with different projections. The cam mechanism may include different driving elements, such as worn gears, wedges, ratchets, etc. Moreover, the camshaft of the cam mechanism may be positioned at various angles and may work with different sizes and/or shaped levers. The overall dimensions of the zero mounting force solder-free connector may be altered depending upon the electrical elements used, the desired strength, the structural rigidity, and thermal stability.

Many modifications may be made to adapt the teachings of the present invention to a particular situation without departing from the scope thereof. Therefore, it is intended that the present invention not be limited to the various exemplary embodiments disclosed, but that the present invention includes all embodiments falling within the scope of the appended claims.

What is claimed is:

1. A zero mounting force solder-free connector for use with a receiving substrate, the connector comprising:

a housing; and at least one pin associated with the housing, the at least one pin adapted to cooperate with an opening in the receiving substrate, the at least one pin movable relatively to the housing between a first position where the at least one pin freely enters the opening in the receiving substrate, and a second position where the at least one pin engages the opening to establish a mechanical connection and an electrical connection with the at least one opening, the at least one opening including a portion of a conductive circuit pathway within the at least one opening wherein movement of the pin from the first position to the second position is rotary.

2. The connector as in claim 1, wherein the at least one pin has a substantially elliptical cross section.

3. The connector as in claim 2, wherein the opening in the receiving substrate has a substantially elliptical cross-section.

4. The connector as in claim 1, wherein the opening in the receiving substrate is plated with an electrically conductive material.

5. The connector as in claim 1, wherein the at least one pin has a substantially oval cross-section.

6. The connector as in claim 5, wherein the opening in the receiving substrate has a substantially oval cross-section that receives the at least one pin when the at least one pin is in the first position.

7. The connector as in claim 6, wherein movement of the at least one pin from the first position to a second position is rotary.

8. The connector as in claim 7, wherein the opening in the receiving substrate is plated with an electrically conductive material and is a portion of the conductive circuit pathway.

9. A zero mounting force solder-free connector for use with a printed circuit board, the connector comprising:

at least one pin adapted to cooperate with an opening in the printed circuit board such that when the pin is in a first position the pin freely enters the opening, and when the pin is moved to a second position the pin binds in the opening to thereby establish a mechanical connection with the opening and an electrical connection to a printed circuit on the board, and a mechanism that cooperates with the pin to cause the pin to move from the first position to the second position to thereby secure the connector to the printed circuit board, including a cam and a cam follower that cooperate with the pin to rotate the pin relative to the housing from the first position to the second position.

10. The connector as in claim 9, wherein the cam follower includes an opening that cooperates with the pin to cause the pin to rotate when the cam is moved.

11. A zero mounting force solder-free connector for use with a circuit board and a module to be mechanically and electrically coupled via the connector to the board, the connector comprising:

at least one pin adapted to cooperate with an opening in the circuit board such that when the pin is in a first position the pin freely enters the opening, and when the pin is moved to a second position the pin binds in the opening to thereby establish a mechanical connection with the opening and an electrical connection to a conductive pathway on the board, and the pin is adapted to mechanically and electrically couple the pin to the module and thereby electrically link the module via the connector to the conductive pathway on the board;

wherein the connector further includes a mechanism that cooperates with the pin to cause the pin to move from the first to the second position to thereby secure the connector to the circuit board;

wherein the mechanism includes a cam and a cam follower that cooperate with a pin to rotate the pin relatively to the housing from the first position to the second position.

12. The connector as in claim 11, wherein the cam follower includes an opening that cooperates with the pin to cause the pin to rotate when the cam is moved.

13. The connector as in claim 12, wherein the pin has a substantially elliptical cross-section.

14. The connector as in claim 13, wherein the opening in the board has a substantially elliptical cross section that mates with the pin when the pin is in the first position.

15. The connector as in claim 14, wherein movement of the pin from first position to the second position is rotary.

16. The connector as in claim 15 wherein the opening is plated through.

* * * * *

UNITED STATES PATENT AND TRADEMARK OFFICE

CERTIFICATE OF CORRECTION

PATENT NO. : 6,817,878 B2
APPLICATION NO. : 10/032329
DATED : November 16, 2004
INVENTOR(S) : Combs et al.

It is certified that error appears in the above-identified patent and that said Letters Patent is hereby corrected as shown below:

On the face page, in field (75), under "Assignee:, in column 1, line 3, delete "Ralyomand" and insert -- Raiyomand --, therefor.

In column 10, lines 58 - 59, in Claim 1, delete "relatively" and insert -- relative --, therefor.

In column 10, line 66, in Claim 1, after "opening" insert -- , --.

In column 11, line 33, in Claim 9, after "and" delete "a".

In column 12, line 19, in Claim 11, after "first" insert -- position --.

In column 12, line 23, in Claim 11, delete "relatively" and insert -- relative --, therefor.

Signed and Sealed this

Thirteenth Day of May, 2008

JON W. DUDAS
*Director of the United States Patent and Trademark Office*